United States Patent [19]

Keil

[11] 4,300,844

[45] Nov. 17, 1981

[54] MOVING HEAD PRINTER MECHANISM

[75] Inventor: Ronald W. Keil, Corvallis, Oreg.

[73] Assignee: Hewlett-Packard Company, Palo Alto, Calif.

[21] Appl. No.: 68,809

[22] Filed: Aug. 22, 1979

[51] Int. Cl.[3] ..... B41J 3/04; H05B 1/00

[52] U.S. Cl. ..... 400/120; 219/216

[58] Field of Search ..... 400/118–121, 124–125; 219/216; 308/3 R, 3 A

[56] References Cited

U.S. PATENT DOCUMENTS

| | | | |
|---|---|---|---|
| 3,881,587 | 5/1975 | Okabe | 400/121 X |
| 3,989,131 | 11/1976 | Knirsch et al. | 400/120 |
| 4,000,393 | 12/1976 | Cochran et al. | 400/120 X |
| 4,030,587 | 6/1977 | Walker | 400/121 |
| 4,170,422 | 10/1979 | Bilek | 400/120 |

FOREIGN PATENT DOCUMENTS

| | | | |
|---|---|---|---|
| 52-9443 | 1/1977 | Japan | 400/119 |

*Primary Examiner*—E. H. Eickholt

*Attorney, Agent, or Firm*—Edward L. Miller

[57] ABSTRACT

A single spring presses a moving printhead against a pivotable platen while simultaneously engaging a sliding carrier upon two parallel cross slides. The printhead is mounted on an arm hinged to the carrier. The axis of the hinge is parallel to the line of motion of the carrier along the cross slides. The spring pushes the arm away from the carrier and produces a moment about the hinge which keeps the carrier engaged with the cross slides. The platen pivots to remain completely parallel to the surface of the printhead as the carrier moves along the cross slides.

3 Claims, 12 Drawing Figures

MOVING HEAD PRINTER MECHANISM

BACKGROUND AND SUMMARY OF THE INVENTION

Low cost thermal or electrostatic printers are often of the type having a moving printhead. In such printers the printhead is moved across the paper, defining a rectangular field within which characters can be printed.

The carrier assembly for a moving printhead must hold the printhead in intimate flat contact with the sensitized paper to be printed upon, and must maintain the contact force within narrow margins. It must do this while allowing the head to be moved smoothly and with little friction across the paper along a particular path. In addition, the carrier should be easily removable for servicing the printhead or related parts.

Various designs have been used to meet alignment and contact force criteria. Some designs involve complicated adjustable mechanisms. Some involve mechanisms that do not lend themselves to easy assembly, or disassembly and re-assembly, because, for example, of captive parts accessible only after a substantial disassembly of the mechanism.

If the functions of aligning the printhead, guiding its motion, and generating contact pressure are each performed by separate mechanical constructs the number of parts increases, with a corresponding increase in the number of possible failure modes. It is advantageous if the number of parts can be reduced by using mechanical constructs having multiple functions. The advantage is greater still if the ease of assembly and disassembly can be enhanced at the same time.

Accordingly, a principal object of the present invention is to provide a transport mechanism for a moving head printer wherein the force available form a single spring provides both the contact force of the printhead with the paper, as well as a force for keeping the printhead carrier aligned and engaged with a guide.

Another object of the invention is to provide in a moving head printer a transport mechanism particularly well suited for cooperation with a platen that pivots to maintain intimate flat contact between the printhead and the paper.

A further object of the invention is to provide such a transport mechanism having a carrier that is easily removed without substantial disassembly of the printer.

These and other objects of the invention will become apparent to those skilled in the art as the description of the invention proceeds.

According to a preferred embodiment of the present invention the same force that provides the contact pressure between the printhead and the paper also creates a rotational tendency in the printhead carrier, thereby keeping the carrier engaged with cross slides that support and guide it for motion across the paper.

The paper passes over a platen that supports the paper for contact with the printhead. The platen is approximately as long as the paper is wide, and is at least as wide as the indicia printed during any single pass of the printhead. The lengthwise axis of the platen is generally parallel to the path of printhead motion.

Above the paper and generally parallel to both the surface of the platen and to its lengthwise direction is a first cross slide. The printhead carrier slidably engages the first cross slide in a direction that is away from the platen and toward the first cross slide. Spaced parallel to the first cross slide, and at a distance away from it that is somewhat less than the length of the carrier, is a second cross slide. The carrier slidably engages the second cross slide from a direction opposite that for the first cross slide. Because the carrier engages each cross slide from an opposing direction a suitable force applied to the carrier will keep it slidably engaged with them. A groove in the carrier engages one of the cross slides and simultaneously aligns the carrier upon both cross slides.

An arm is hinged to the carrier at a point between the two cross slides. The axis of the hinge is parallel to the cross slides. The printhead is attached to the arm at a suitable point by any convenient means. When the arm is moved about the hinge and away from the carrier the printhead contacts the platen. The locations of the cross slides and the shapes of the carrier and the arm are such that the printhead lies in, or very nearly in, the plane of the printing surface of the platen when the arm is urged against the platen.

The force from a spring moves the arm away from the carrier and urges it against the platen. The same force also exerts itself as a rotational tendency of the carrier about the hinge axis, which keeps the carrier engaged with the cross slides. A rotational tendency about the hinge axis is ensured by arranging that the extension of a line perpendicular to the arm at the point of contact with the platen does not pass between the two cross slides.

If the extension of such a line does pass between the two cross slides there will be a rotational tendency about each cross slide such that both cross slides must be on the same side of the carrier, instead of on opposing sides.

The printhead cooperates in an advantageous way with the platen which is pivoted about a pivot axis parallel to the hinge axis. In response to the contact force of the printhead against the platen, the latter rotates about the pivot axis to align its printing surface parallel to the printing surface of the printhead. This helps maximize the degree of flat intimate surface contact of the printhead with the paper.

The carrier is easily removed by manually squeezing the arm and carrier together with the thumb and forefinger to override the force of the spring, while rotating the carrier about the first cross slide until the assemblies are clear of each other. The carrier is easily re-installed by reversing the steps.

DESCRIPTION OF THE PREFERRED EMBODIMENT

Figure 1:
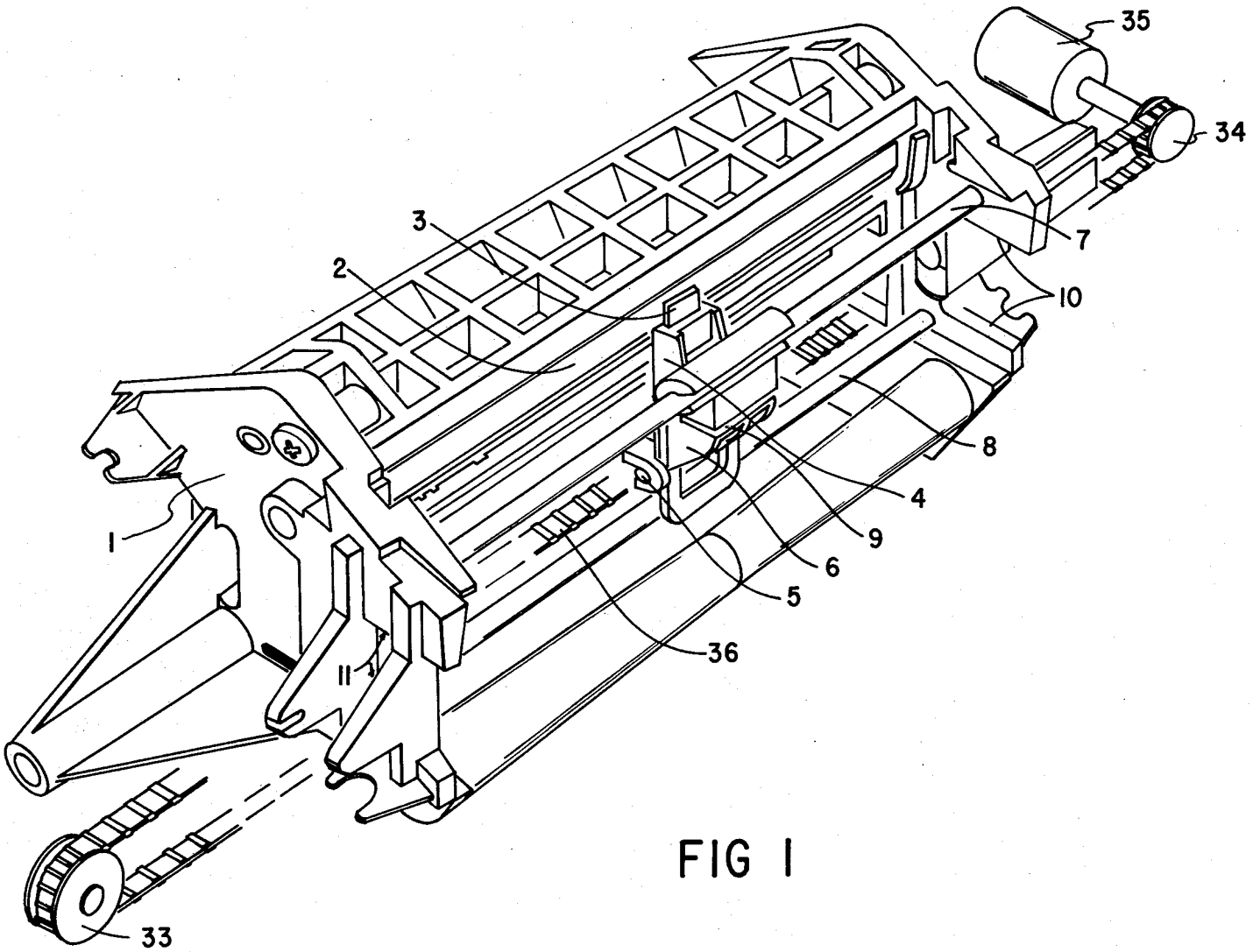
FIG. 1 is a perspective view of a moving head printer constructed in accordance to a preferred embodiment of the invention.

In accordance with a preferred embodiment of the invention, FIG. 1 shows a moving head printer mechanism including a frame 1 and a platen 2. The platen 2 pivotally engages the frame and pivots to maximize contact with a printhead 3. The printhead 3 is mounted upon an arm 4 hinged by a pin 5 to a carrier 6. The printhead 3 may be mounted to the arm 4 in any suitable manner; a preferred method is to glue it to the arm. The carrier 6 slidably engages each of the parallel guide cross slide 7 and support cross slide 8. The cross slides 7 and 8 are preferably circular rods, although other shapes are possible. The guide cross slide 7 and support cross slide 8 are each supported by engaging their ends with the frame 1. The printing surface of the platen 2 is generally parallel to the guide cross slide 7.

The carrier is transversely slidable along both the guide cross slide and support cross slide to allow the printhead 3 to traverse the length of the platen 2. Any suitable means can be used to move the carrier 6. A preferred method is to use a toothed belt 36 engaging a slot 9 in the carrier 6 and passing through frame openings 10 and 11. The belt is supported by a pair of pulleys 33 and 34 and driven by a motor 35.

Figure 2B:
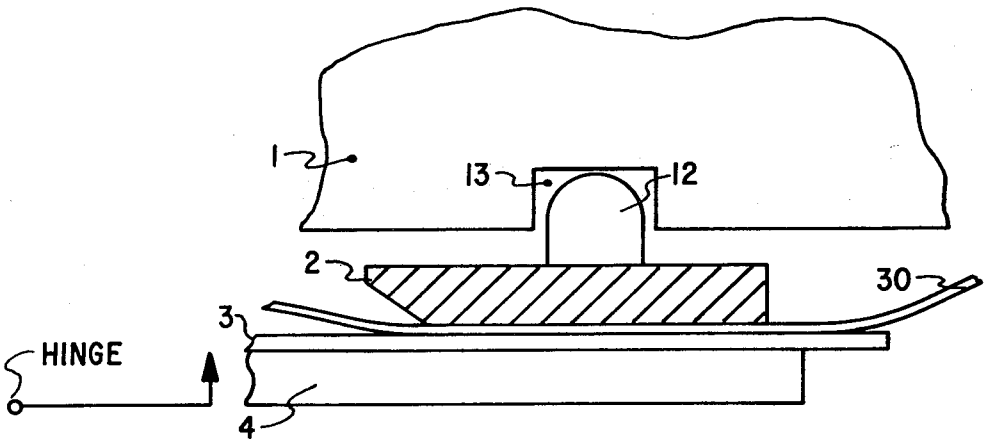
FIG. 2*b* is an enlarged cross sectional view of the hinged arm, printhead, pivotable platen and frame, of the printer of FIG. 1, and shows the path of the paper between the printhead and platen.
Figure 2A:
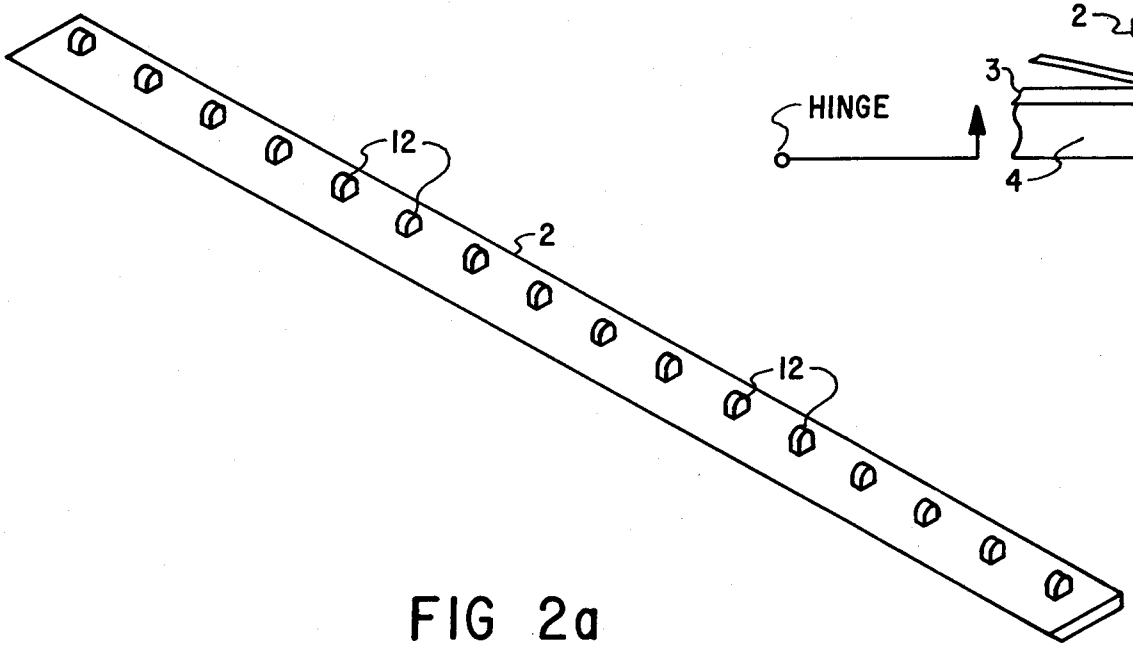
FIG. 2*a* is an isometric view of the underside of a pivotable platen usable with the printer of FIG. 1.

As shown in FIG. 2*a*, the platen 2 incorporates a number of projections 12. As shown in FIG. 2*b*, the projections 12 engage a recess 13 of the frame 1. The recording medium 30 passes between the platen 2 and printhead 3. The platen 2 supports the recording medium 30 for contact with the printhead 3. The platen 2 pivots about the projections 12 to automatically maximize the degree of contact between the recording medium 30 and the printhead 3. The recess 13 in frame 1 keeps the platen 2 parallel to the guide cross slide 7 even though the platen 2 pivots.

Figure 3B:
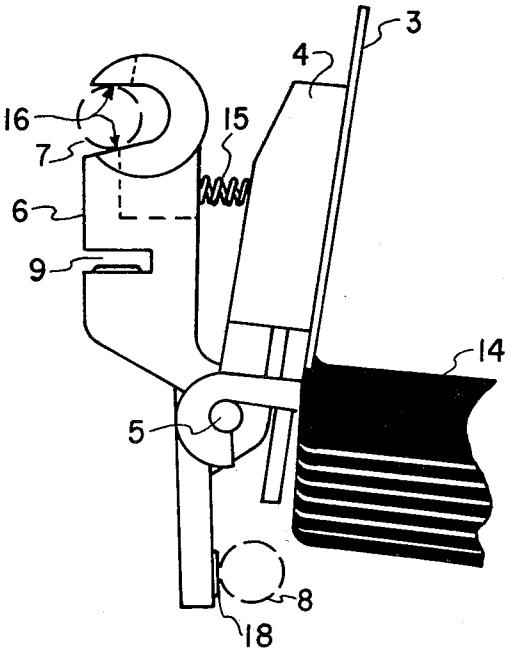
FIG. 3*b* is a side elevational view of the carrier and hinged arm of the printer of FIG. 1.

The printhead 3 is brought into contact with the platen 2, or with the intervening recording medium 30, through the hinge action of the pin 5 (shown in FIG. 1) and a spring 15 (shown in FIG. 3*b*). The compression spring 15 urges the arm 4 against the platen 2, providing the force required to cause the platen 2 to pivot.

The pivoting of the platen 2 in conjunction with the hinged movement of the arm 4 enhances the ability of the printhead 3 to remain in full contact with the recording medium 30 as the carrier 6 is moved along the cross slides 7 and 8. Otherwise, minor variations in the frame 1, in the straightness or locations of the cross slides 7 and 8 or even in the thickness of the recording medium itself, could lessen the degree of contact. Also, a pivotable platen reduces the need for high precision parts or adjustable elements in the assembly, and is self-compensating for wear experienced by the moving parts.

Figure 3A:
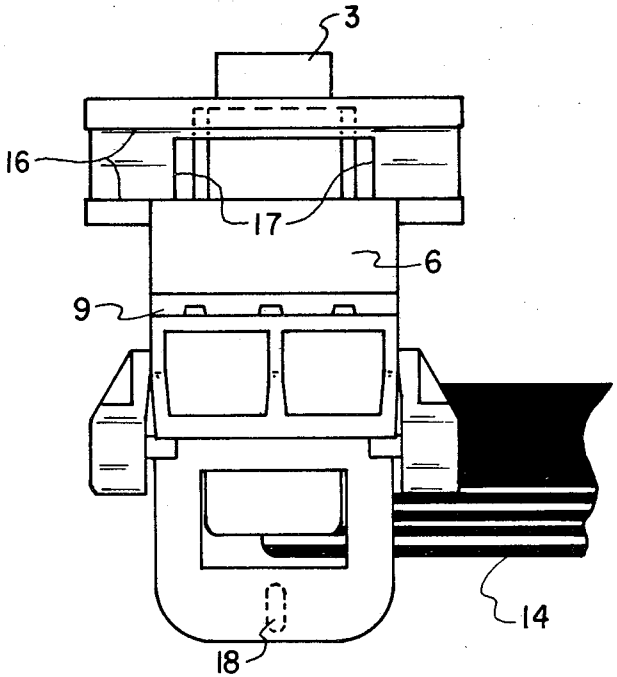
FIG. 3*a* is a front elevational view of the carrier and hinged arm of the printer of FIG. 1.

As shown in FIGS. 3*a* and 3*b*, electrical connection is made to the printhead 3 by means of a flexible ribbon connector 14. The carrier 6 slidably engages guide cross slide 7 through the action of a guide follower in the form of a slot 16 having a tapered cross section. The slot 16 has a recessed central region 17 so that only at its two end portions does the slot 16 contact the guide cross slide 7. This provides two points of a three point suspension of the carrier 6. Furthermore, the diameter of the rod serving as the guide cross slide 7 is chosen so that it contacts the walls of the slot 16 only in the central portion of the tapered section. This provides positive engagement between the guide cross slide 7 and the slot 16 for guiding the carrier 6 along the guide cross slide 7, minimizes friction, and is self-adjusting with respect to wear.

The carrier 6 slidably engages the support cross slide 8 through the action of a support follower in the form of a rib 18. The rib 18 provides the third point of the three point suspension of the carrier 6. It minimizes friction and is self-adjusting with respect to wear.

Figure 4:
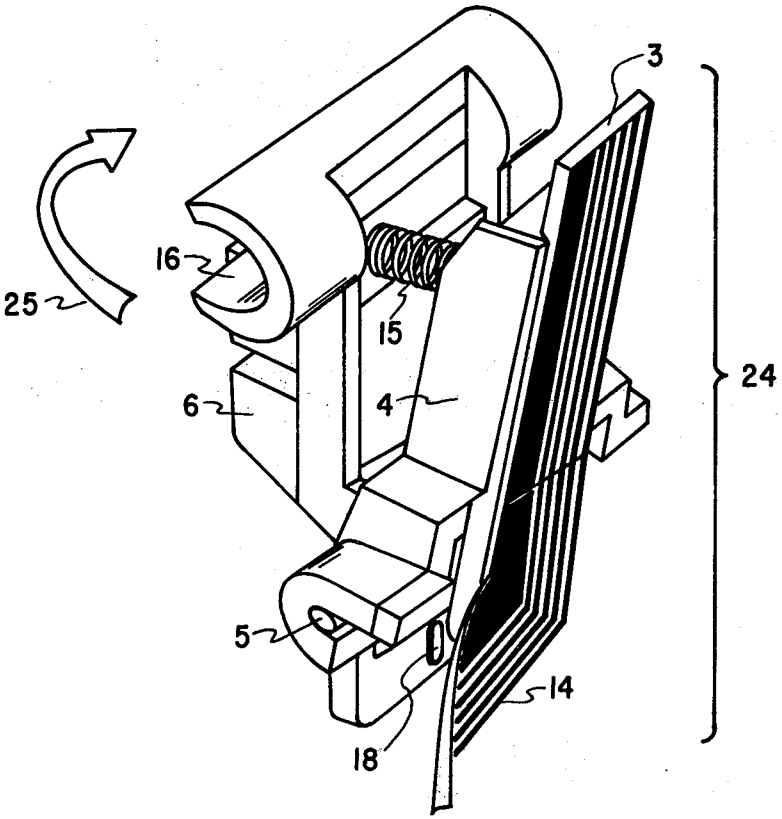
FIG. 4 is a perspective rear view of the carrier and hinged arm of the printer of FIG. 1.

Shown in FIGS. 3*b* and 4 are the locations of the spring 15, which urges the arm 4 away from the carrier 6, and the hinge formed in part by the pin 5.

Figure 5:
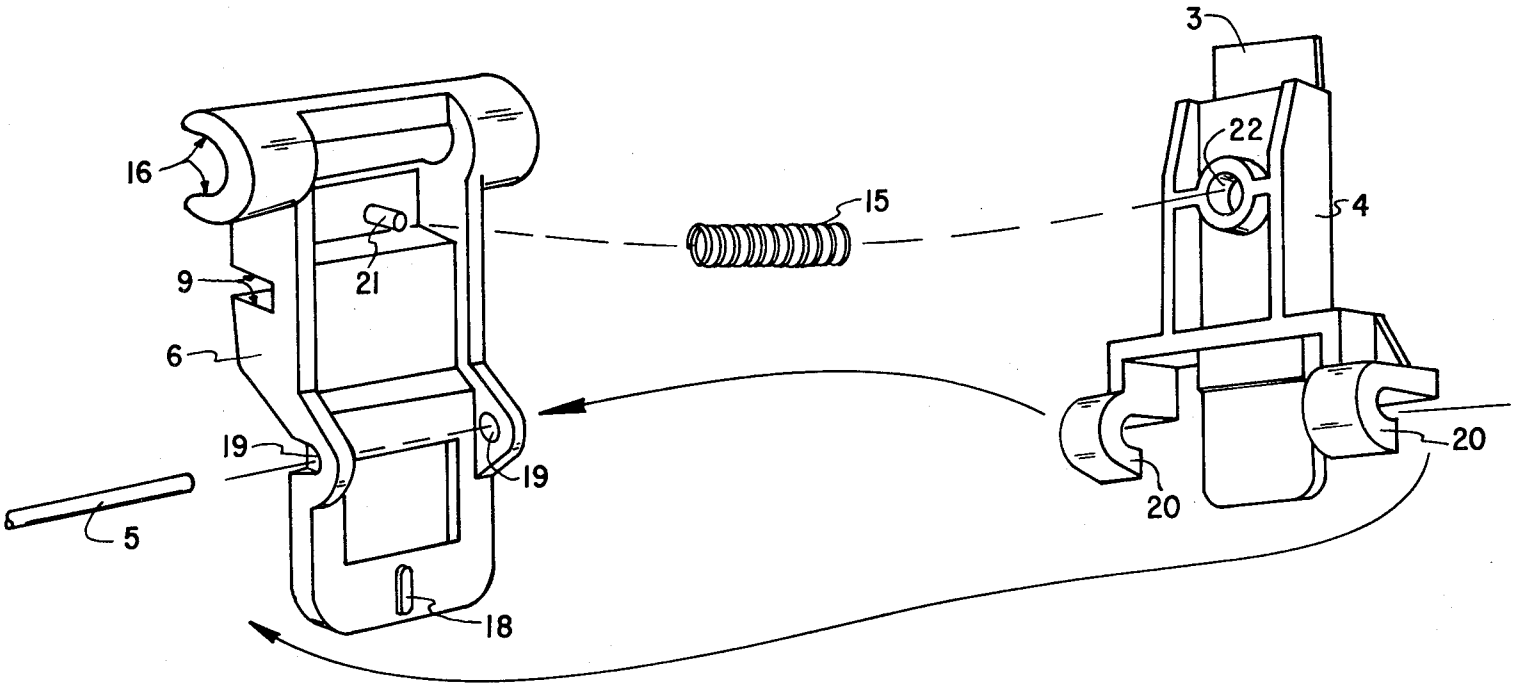
FIG. 5 is an exploded view of the carrier, hinged arm, and spring of the printer of FIG. 1.

The formation of the hinge and the retention of the spring 15 are shown in FIG. 5. A pair of holes 19 in the carrier 6 receive the pin 5 and form a close fit with it. When assembled, a pair of hooks 20 on the arm 4 also engage the pin 5, completing the hinge. In operation the pin 5 is parallel to the guide cross slide 7. The pair of hooks 20 could also be holes in the arm 4.

Any of a variety of suitble means can be used to retain the spring 15. In the instant embodiment a spring well 22 on the arm 4 retains one end of the spring, while a projection 21 on the carrier 6 engages the spring at its other end.

Figure 6:
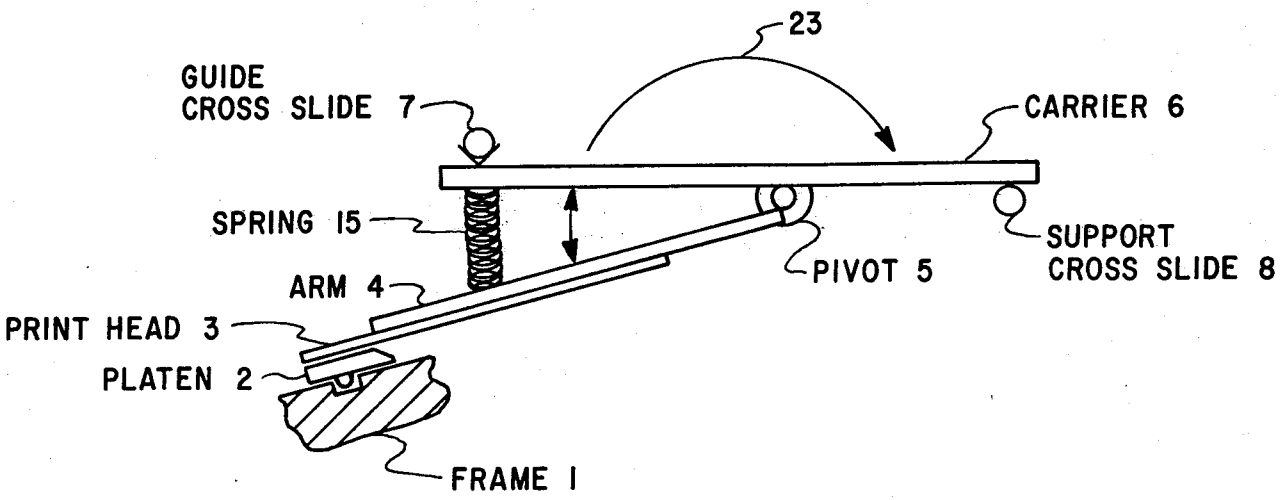
FIG. 6 is a schematic illustration of a preferred embodiment of the invention.
Figure 7A:
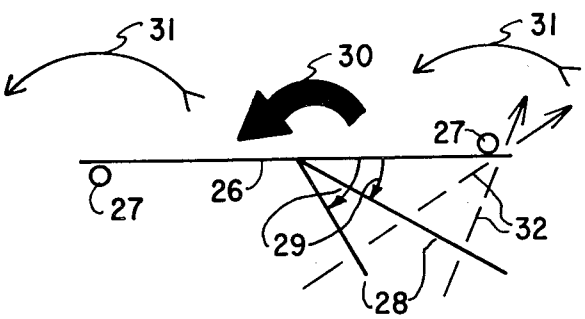
FIGS. 7*a*–7*d* are schematic illustrations of various embodiments of the invention.
Figure 7B:
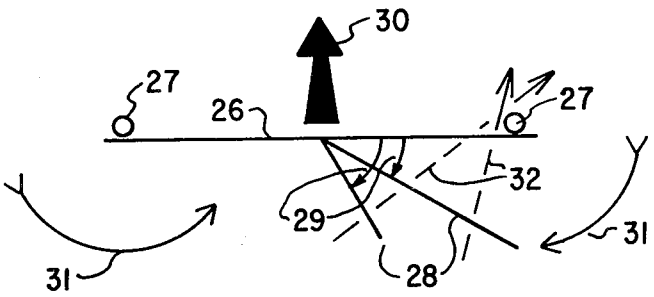
Figure 7C:
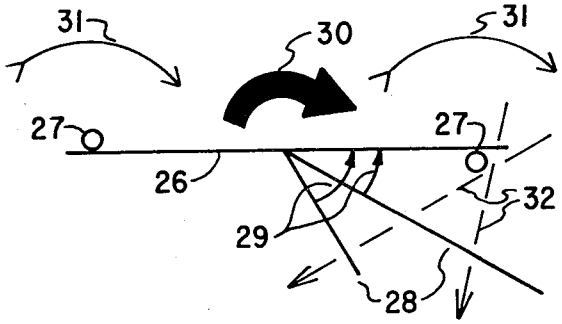
Figure 7D:
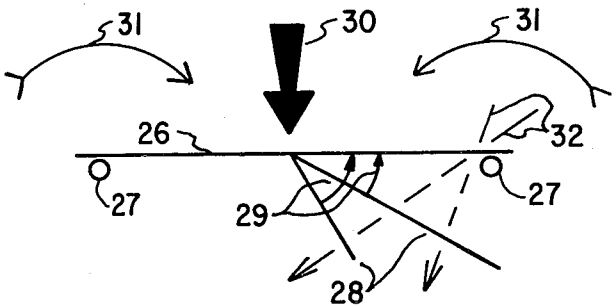

FIG. 6 schematically illustrates the forces acting within the preferred embodiment. Specifically, the spring 15 between the arm 4 and the carrier 6 provides two basic actions. First, it serves to urge the printhead 3 against the platen 2 and produces any necessary pivoting of the platen. Second, it provides a moment in a direction shown by arrow 23. The moment keeps the carrier 6 slidably engaged with the guide cross slide 7 and with the support cross slide 8.

Referring once again to FIG. 4, the printhead assembly 24 can be easily removed from the rest of the transport mechanism by simply squeezing arm 4 against carrier 6, rotating assembly 24 and the guide cross slide 7 in the direction of arrow 25, and then lifting assembly 24 free of the guide cross slide 7.

FIGS. 7*a*–7*d* schematically illustrate four embodiments of the invention. In each of the four embodiments a rigid member 26 (corresponding to the carrier 6) is supported between two cross slides 27 (corresponding to the cross slides 7 and 8). Each embodiment shows two of many possible positions of an arm 28 pivotally attached to the rigid member 26. The arm 28 corresponds to the arm 4 and the printhead 3 of earlier Figures, while a bias means represented by arrows 29 corresponds to the spring 15 or any other suitable bias arrangement. The arrow heads of the arrows 29 indicate the direction of the bias. For example, in FIG. 7*a* bias means 29 could be replaced with the compression spring 15 of FIGS. 3*b*, 4, 5, and 6. However, merely by extending the arm to create a corresponding angle on the opposite side of the rigid member 26 the location of the spring can be altered. Similarly, the compression spring can be replaced by weight tension or torsion bias means by suitable connection to the arm 28 and rigid member 26.

The four embodiments arise by choosing between two mutually exclusive possibilities for each of two independent choices. The first of the two independent choices is whether the bias means represented by the arrows 29 is to urge the arm 28 toward (FIGS. 7*c*–*d*) or away (FIGS. 7*a*–*b*) from an appropriate cross slide. The second of the two independent choices is whether the rigid member 26 is supported by engaging the cross slides 27 from opposing sides, as in FIGS. *7a* and *7c*, or supported by engaging the cross slides 27 from the same side, as in FIGS. *7b* and *7d*. This is the same as noting whether the line of action of the force of the platen acting upon the printhead passes, when extended, between the two cross slides, as in FIGS. *7b* and *7d*, or not, as in FIGS. *7a* and *7c*.

In FIGS. *7a–d* heavy arrows 30 denote the net motive tendency of the carrier. Light arrows 31 denote the tendency of the carrier to rotate about the associated cross slide if the other cross slide were absent. Dotted arrows 32 indicate representative locations and associated directions of forces that the platen (not shown) may impart to the arm.

The preferred embodiment described in connection with FIGS. 1–6 falls into the category of FIG. *7a* with a compression spring.

I claim:

1. Apparatus for moving a recording element across a recording medium, the apparatus comprising:

a frame including a printing surface for supporting a recording medium;

a first cross slide spaced a constant distance away from the printing surface and supported by the frame;

a second cross slide parallel to the first cross slide and supported by the frame;

a carrier including first and second follower means, the first follower means for engaging the first cross slide to guide transverse carrier motion therealong when urged thereagainst, the second follower means for supporting the carrier against the second cross slide when urged thereagainst, neither of the first and second follower means enclosing their respective cross slides;

an arm pivotally connected to the carrier, pivotable against the printing surface and including a recording element for contacting the recording medium; and biasing means mounted between the arm and the carrier for both biasing the arm against the printing surface and urging the carrier to rotate about the pivotal connection, the rotation urging the first follower means against the first cross slide and urging the second follower means against the second cross slide, whereby the bias means engages the carrier with the first and second cross slides for transverse motion therealong while also biasing the recording element against the printing surface.

2. Apparatus for moving a recording element across a recording medium, the apparatus comprising:

a frame including a printing surface for supporting a recording medium;

a first cross slide spaced a constant distance away from the printing surface and supported by the frame;

a second cross slide parallel to the first cross slide and supported by the frame;

a carrier including first and second follower means, the first follower means for engaging the first cross slide to guide transverse carrier motion therealong when urged thereagainst, the second follower means for supporting the carrier against the second cross slide when urged thereagainst, neither of the first and second follower means enclosing their respective cross slides;

an arm pivotally connected to the carrier between the first and second follower means, pivotable against the printing surface and including a recording element for contacting the recording medium; and biasing means mounted between the arm and the carrier for both biasing the arm against the printing surface and urging the carrier to rotate about the pivotal connection, the rotation urging the first follower means in a first direction against the first cross slide and urging the second follower means in an opposing direction against the second cross slide whereby the bias means engages the carrier with the first and second cross slides for transverse motion therealong while also biasing the recording element against the printing surface.

3. Apparatus as in claims 1 or 2 wherein the printing surface comprises a platen in direct contact with the frame that under the contact pressure of the printhead pivots about a single axis parallel to the cross slides to align itself with the printhead.

* * * * *

UNITED STATES PATENT AND TRADEMARK OFFICE

CERTIFICATE OF CORRECTION

PATENT NO. : 4,300,844

DATED : November 17, 1981

INVENTOR(S) : Ronald W. Keil

It is certified that error appears in the above—identified patent and that said Letters Patent is hereby corrected as shown below:

Column 1, line 37, "form" should be --from--;

Column 4, line 40, "and" should be --about--;

Column 4, line 60, "weight" should be --either--;

Signed and Sealed this

*Ninth* Day of *February 1982*

[SEAL]

*Attest:*

GERALD J. MOSSINGHOFF

*Attesting Officer*

*Commissioner of Patents and Trademarks*